United States Patent [19]

Woolslayer et al.

[11] 3,978,994

[45] Sept. 7, 1976

[54] PIPE RACK WITH PIVOTED FINGERS

[75] Inventors: Homer J. Woolslayer; Cecil Jenkins, both of Tulsa, Okla.

[73] Assignee: Lee C. Moore Corporation, Tulsa, Okla.

[22] Filed: July 7, 1975

[21] Appl. No.: 593,473

[52] U.S. Cl. ..... 214/2.5

[51] Int. Cl.[2] ..... E21B 19/14

[58] Field of Search ..... 214/2.5; 221/105, 108; 211/60 S; 175/85

[56] References Cited

UNITED STATES PATENTS

| | | | |
|---|---|---|---|
| 2,161,719 | 6/1939 | Minyard et al. | 211/60 S |
| 3,887,086 | 6/1975 | Woolslayer et al. | 214/2.5 |

*Primary Examiner*—Stanley H. Tollberg

*Attorney, Agent, or Firm*—Brown, Murray, Flick & Peckham

[57] ABSTRACT

A plurality of vertically spaced rows of substantially horizontal laterally spaced fingers are pivotally supported at one common end on transverse horizontal axes by means mounted on a carriage beneath the fingers. The carriage is movable from a starting location step by step in a direction lengthwise of the horizontal fingers to first locate at a pipe pickup station a pipe supported by the fingers in the upper row nearest their free ends, and then each successive pipe in that row until all of the pipes have been removed from that row. Thereafter, the upper row of fingers is swung up out of the way and the carriage is returned to its starting location so that its step by step movement can be repeated for each successive upper row of fingers after the row above it has been swung up out of the way.

10 Claims, 7 Drawing Figures

PIPE RACK WITH PIVOTED FINGERS

In our copending patent application, Ser. No. 585,775, filed June 11, 1975, means are shown for gripping a horizontal pipestand that has been raised from a pipe rack, and then swinging that stand up into vertical position over an oil well beneath an oil well drilling derrick. Of course, pipe coming out of the well can be racked by reversing that procedure.

It is an object of this invention to provide a pipe rack for storing pipe horizontally in front of an oil well derrick and for lifting pipe from the rack to a position in which it can be picked up and carried up into upright position inside the derrick in the general manner disclosed in said copending application, for example. Other objects are to provide such a rack in which pipe can be quickly racked and from which pipe can be quickly removed, and which is relatively simple in operation.

The preferred embodiment of the invention is illustrated in the accompanying drawings, in which FIG. 1 is a side view of the pipe rack;

Figure 2:
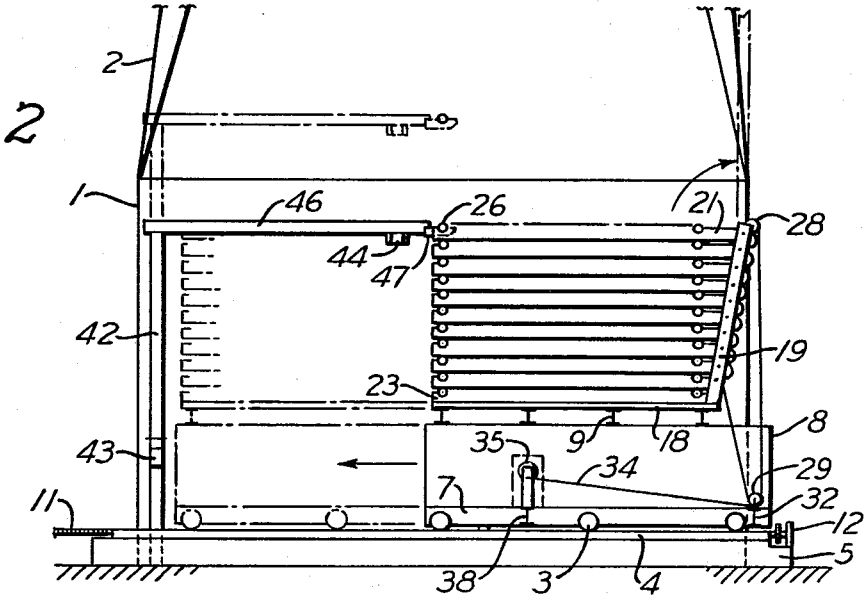
FIG. 2 is an end view.
Figure 1:
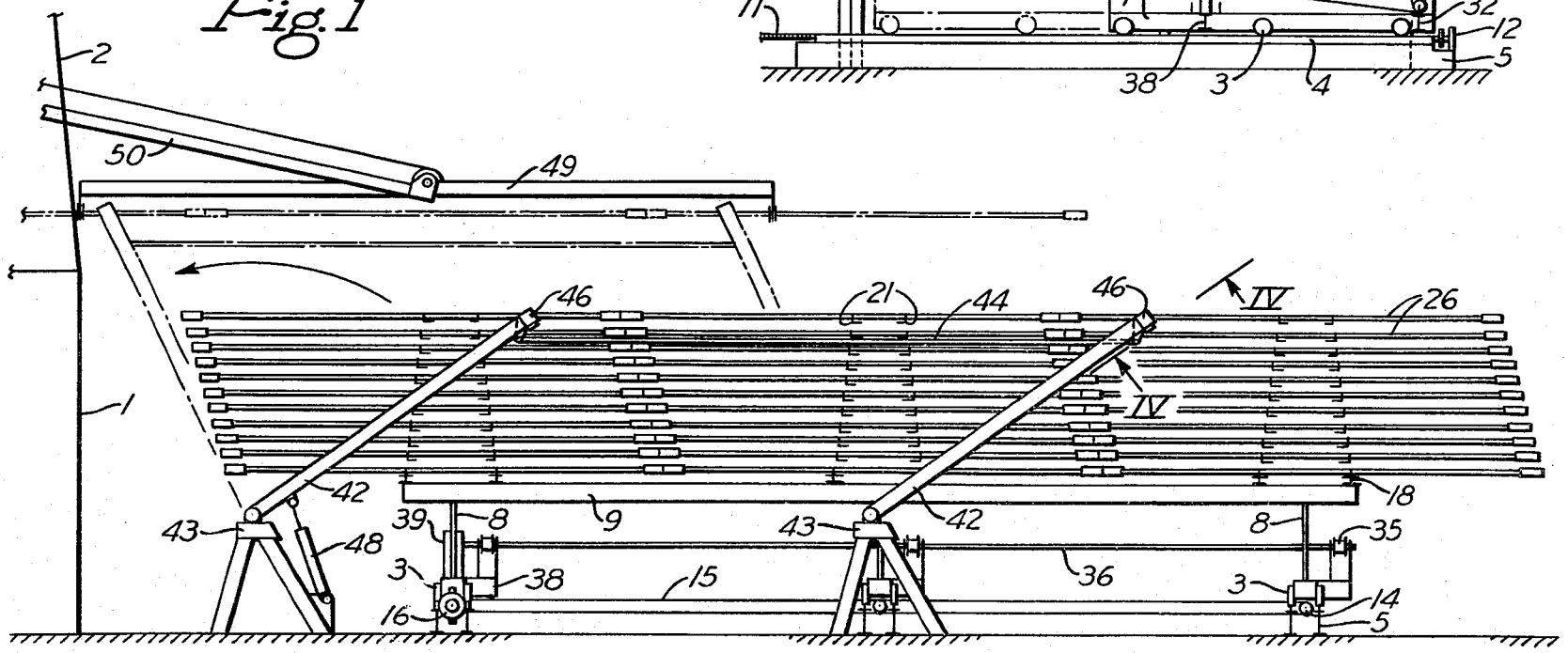
Figure 3:
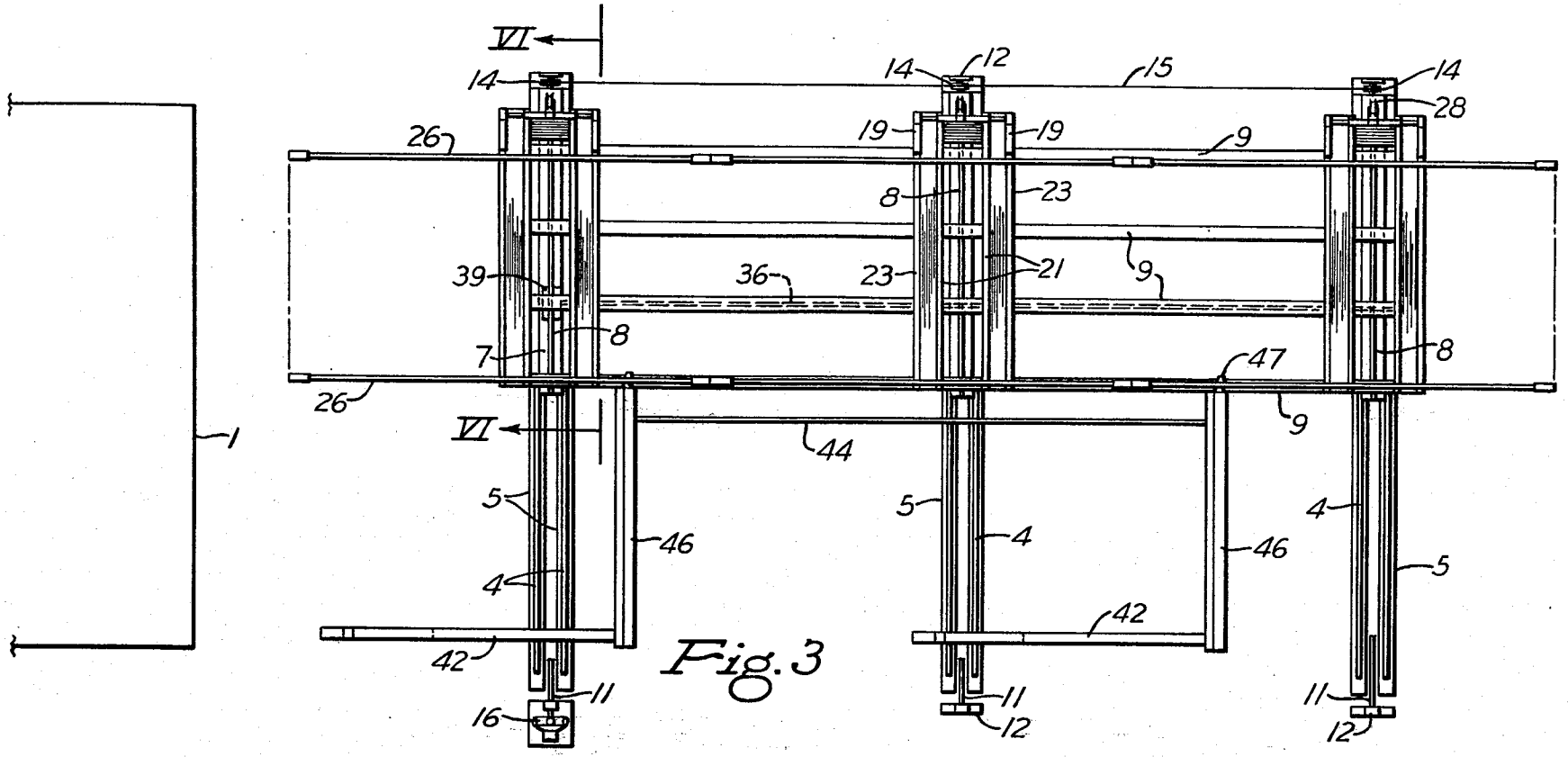
FIG. 3 is a plan view.
Figure 5:
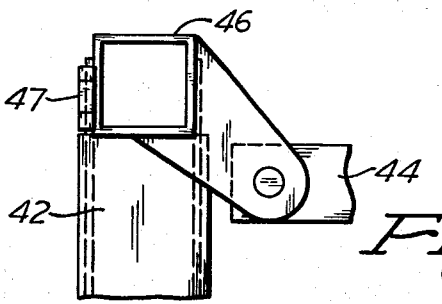
FIG. 5 is an end view of the transfer arm in FIG. 4.

Referring to FIGS. 1, 2 and 3 of the drawings, a pipe rack is located in front of a substructure 1 supporting an oil well drilling derrick 2 or drilling mast. The rack is especially suitable for ships and will be described in that environment. The rack includes a long carriage, which has sets of wheels 3 that run on tracks 4 mounted on top of parallel beams 5 that are supported by the deck of the ship. Preferably, there are three sets of these wheels, each set journaled on the ends of shafts 6 mounted in a pair of horizontal beams 7 from which a metal plate 8 extends upwardly. Resting on top of the three plates and secured thereto are laterally spaced beams 9 that tie the plates together to form the carriage. Means are provided for moving the carriage step by step along the tracks in one direction from a starting location and then for returning the carriage to that location by continuous motion in the opposite direction.

Figure 6:
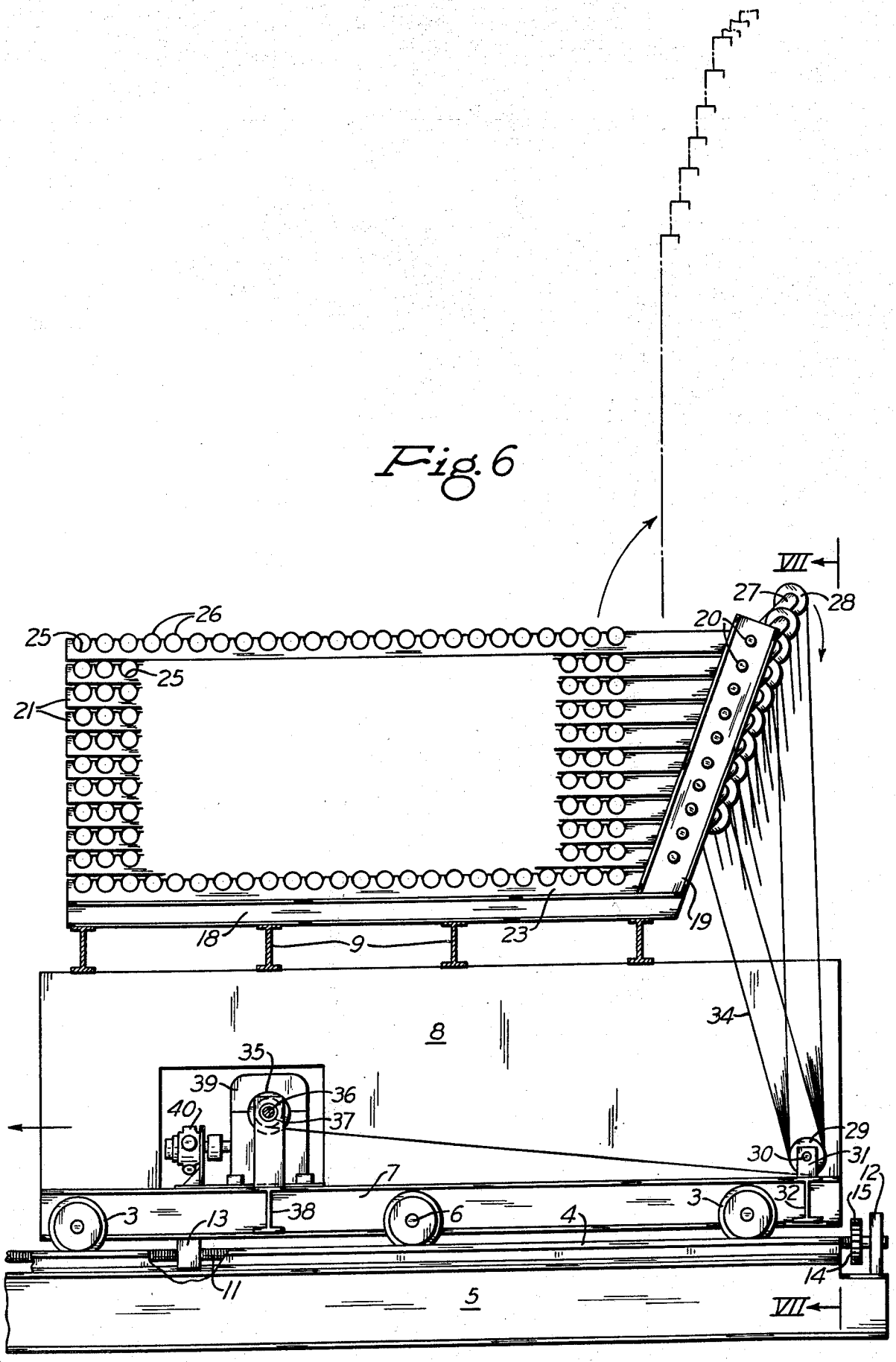
FIG. 6 is an enlarged cross section taken on the line VI—VI of FIG. 3.
Figure 7:
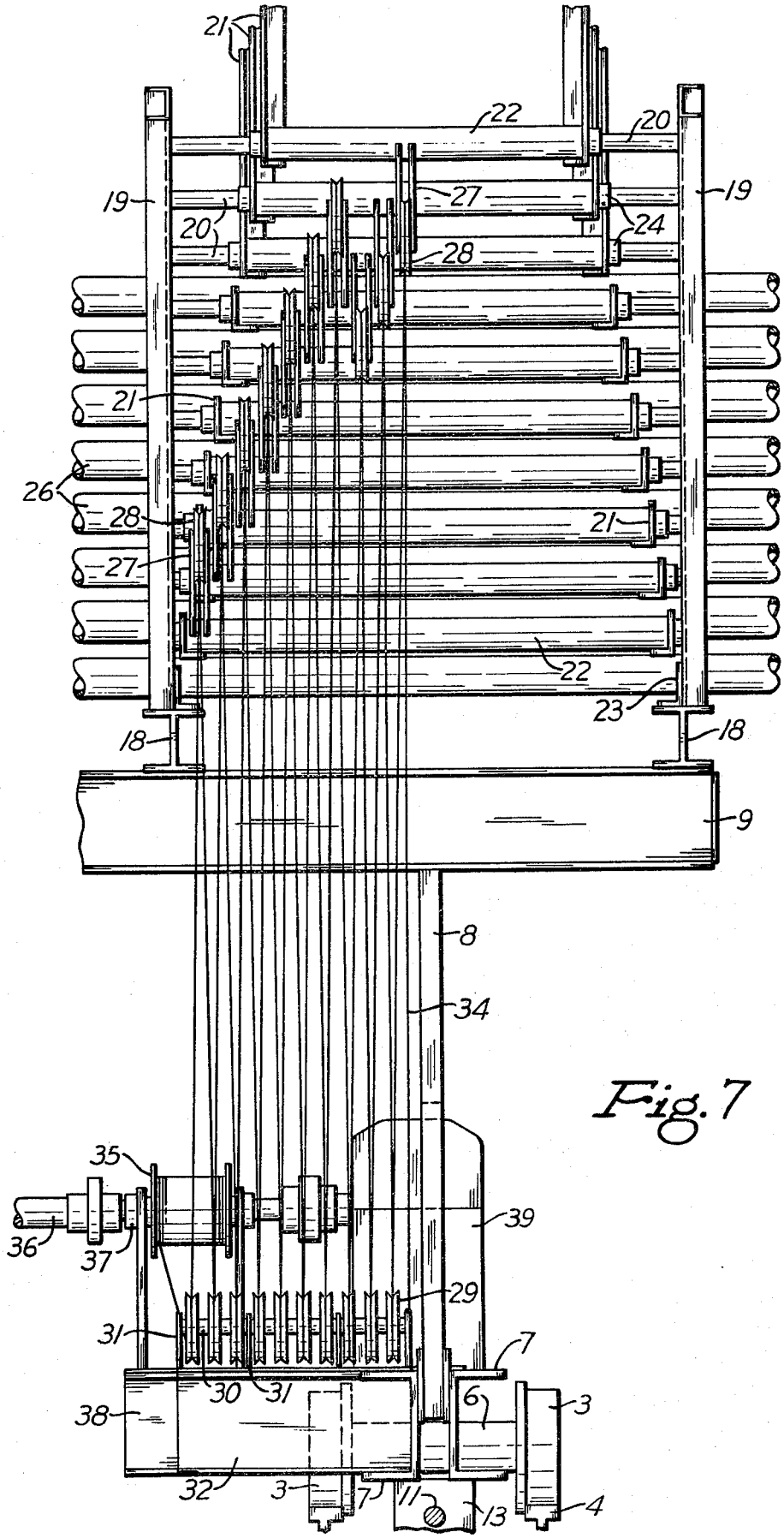
FIG. 7 is a fragmentary side view taken on the line VII—VII of FIG. 6 and showing some of the fingers raised.

One way to move the carriage is to locate a traction screw 11 beneath each set of shafts 6 as shown in FIGS. 6 and 7, with its ends rotatably mounted in bearings 12 mounted on the ends of beams 5. A nut 13 encircles each screw and is rigidly mounted in the bottom of the overlying carriage. The three screws are driven from the same end. Preferably, sprockets 14 are mounted on one end of the screws near their bearings and are connected by an endless chain 15 so that only one screw needs to be driven directly and yet all three will be turned in unison. The drive for the one screw can be any suitable motor connected to one end of the screw, such as by a hydraulic motor 16 and speed reducer as shown in FIG. 3. The motor is under the control of an operator who can start and stop it intermittently to move the carriage step by step in one direction, and then reverse the motor and allow it to run continuously long enough to return the carriage to its starting point.

Extending across upper beams 9 at each end of the carriage and at its center are pairs of cross beams 18 that are secured to the underlying longitudinal beams. Mounted on one end of each of these cross beams is the lower end of an inclined metal channel 19 that extends upwardly and outwardly as shown in FIGS. 2 and 6. Each pair of the channels is provided with two rows of aligned holes, each aligned pair of which contains the opposite ends of a horizontal shaft 20 rigidly mounted therein, whereby the channels are connected by a plurality of vertically spaced shafts as shown in FIG. 7. Rotatably mounted on each shaft are the ends of a pair of angle irons that form racking fingers 21. The same ends of the fingers are rigidly connected to a sleeve 22 between them that is rotatable on the shaft. A further pair of fingers 23 are rigidly mounted on cross beams 18 beneath the pivoted fingers. The lowest pair of pivoted fingers are close to channels 19, but each successive pair of fingers above are closer together so that if all of the fingers are swung upwardly into vertical position, each pair will fit between the pair on the next lower shaft as indicated in dotted lines in FIG. 6. The sleeves can be prevented from moving lengthwise on the shafts by any suitable means, such as collars 24 rigidly mounted on the shafts. In their lower horizontal position, each finger is provided with a row of longitudinally spaced recesses 25 for receiving a pipestand 26. Of course, the recesses in the different fingers at any given level are aligned so that the fingers at that level can support a row of horizontal pipestands. The arrangement is such that the pipestands in each row are spaced a suitable distance from those in the row above and the row below.

Extending rearwardly from each sleeve 22 is a bracket 27, in the outer end of which a vertical sheave 28 is rotatably mounted as shown in FIGS. 6 and 7. These brackets are so positioned along the sleeves that they will not interfere with one another. Beneath each of these sheaves there is a lower sheave 29. All of the lower sheaves are rotatably mounted on a horizontal shaft 30 supported in brackets 31 mounted on top of a short beam 32 projecting from the side of one of the carriage beams 7. One end of a wire line or cable 34 is anchored to a carriage beam and extends upwardly therefrom and over the sheave 28 carried by the top sleeve. From there the cable extends down around the first sheave 29 in the row below. It then extends up and over the sheave carried by the sleeve that is next to the top and then down to the second sheave in the lower row. The cable extends up and down in this manner and around the upper and lower sheaves until it leaves the last sheave in the lower row. From there the cable extends forward to a drum 35 rigidly mounted on a shaft 36 that is journaled in bearings 37 supported on a short beam 38 projecting from the side of a carriage beam 7. This shaft extends the full length of the carriage and supports a drum 35 beneath each set of fingers. The shaft is driven through a speed reducer 39 at one end by means of a suitable motor 40, such as a hydraulic motor.

Figure 4:
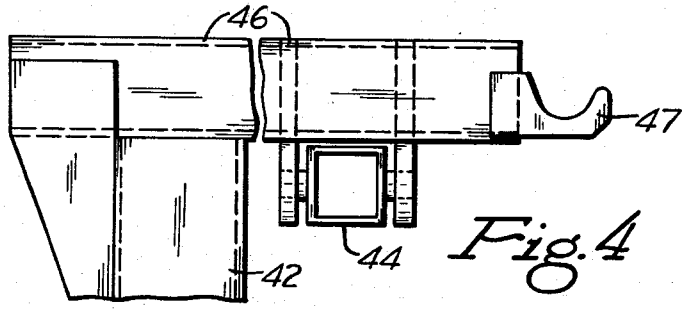
FIG. 4 is an enlarged fragmentary side view of one of the transfer arms, taken on the line IV—IV of FIG. 1.

At the side of the rack opposite the sheaves just referred to there is a pair of legs 42, as shown in FIGS. 1, 2 and 3, the lower ends of which are pivotally mounted on horizontal axes in pedestal bearings 43. The upper portions of these legs are tied together by a link 44 pivotally connected to them. The legs normally slope away from the derrick substructure. Extending horizontally from the upper end of each leg towards the carriage is an arm 46, from the free end of which projects a hook 47 (FIG. 4) that will fit around the bottom of a pipe. The arms can be swung toward and away from the derrick by means of a fluid pressure cylinder 48 (FIG. 1) pivotally connected to one of the legs 42 and the underlying pedestal.

OPERATION

With the legs in their sloping position and with their arms at the same elevation as the space between the two uppermost rows of rack fingers, the carriage is moved by the traction screws 11 from its starting position farthest from the arms toward them until the pipestand supported at the outer or free ends of the upper row of fingers is directly over hooks 47 on the ends of the transfer arms. The hooks are at the pick-up station. The legs then are swung toward the substructure by means of cylinder 48 and this causes the arms to pick up the pipestand above their hooks as shown in FIG. 2 and carry it upwardly and toward the substructure until the leading end of the pipestand is over the derrick floor as indicated by dotted lines in FIG. 1. The pipestand is then lifted from the arms by a strongback 49 supported by the outer end of a vertically movable boom 50, and then the arms are returned to their original position. As soon as that happens, the carriage is moved forward (to the left in FIG. 2) another step to bring the next upper pipestand into position over the arm hooks so that the pipestand can be transported to the derrick. In the meantime, boom 50 has swung the first pipestand up into the derrick, left it and returned to pick up the second pipestand.

This cycle is repeated until all of the pipestands on the upper row of fingers have been removed. The drum shaft 36 then is rotated to wind up cables 34, which will swing the sheaves 28 connected to the top sleeves 22 down and thereby swing the upper row of fingers 21 up to upright position as shown in FIG. 7. The weight of the pipes on the rest of the fingers prevents them from being swung upwardly at the same time. In the meantime, the carriage is driven back in one continuous motion to its original location by reversing the traction screws, and then is moved forward again far enough to carry the outermost pipestand in the upper row, which previously was next to the top row, into position over the ends of the transfer arm hooks which have been lowered far enough for this purpose. This new top row of pipestands now is transferred, one at a time, to the derrick in the same way as the previous row, after which the carriage is returned to its starting position and the cable drums are rotated to swing the empty top row of fingers up to upright position to expose the underlying row of pipestands. This sequence of operation is continued until all of the pipestands that are to be transferred to the derrick have been removed from the pipe rack.

When pipe are being removed from the well, the sequence just described is reversed; that is, the first horizontal pipe to be carried away from the derrick by the transfer arms is deposited on the bottom row of fingers next to their pivoted ends. The carriage then is backed away from the transfer legs one step to permit the arms to be swung up to receive the next horizontal pipestand from the strongback and carry it down to the waiting rack fingers. This cycle is repeated until the lower row of fingers is filled with pipe. Then the carriage is moved its full distance forward and the cable drums 35 are reversed to permit the next row of fingers to swing down onto the row of pipestands below them so that those fingers can receive a row of pipestands. This is continued until all of the pipestands have been removed or all of the finger recesses 25 have been filled.

It will be seen that a great many pipestands can be racked in a relatively small space, and that to do this the rack carriage does not require a lot of travel space. Also, under ship roll conditions, the pipestands are restrained from lateral movement.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. A drill pipe rack comprising a plurality of vertically spaced rows of laterally spaced fingers, the fingers in each row being formed at longitudinally spaced points along them for supporting laterally spaced drill pipe extending across the fingers, a carriage beneath said fingers, means mounted on the carriage pivotally supporting said fingers at one common end on transverse horizontal axes, means for moving the carriage from a starting location step by step in a direction lengthwise of the horizontal fingers to first locate at a pipe pick-up station a pipe supported by the fingers in the upper row nearest their free ends and then each successive pipe in that row until all of the pipe have been removed from that row, means for thereafter swinging said upper row of fingers up out of the way, and means for returning the carriage to said starting location, whereby said step by step movement of the carriage can be repeated for each successive upper row of fingers after the row above it has been swung up out of the way.

2. A pipe rack according to claim 1, in which said fingers-swinging means include drum means rotatably mounted on said carriage, cable means connected with said fingers and drum means, and means on the carriage for rotating the drum means to wind the cable means thereon to swing the fingers upwardly.

3. A pipe rack according to claim 1, in which said fingers-swinging means include upper vertical sheaves projecting from the pivoted ends of the fingers, lower vertical sheaves supported by said carriage below said upper sheaves, a drum rotatably mounted on said carriage, a cable having one end attached to the drum and extending therefrom around each lower and upper sheave alternately in succession starting with the sheave for the lowest pivoted fingers, means anchoring the opposite end of the cable, and means on the carriage for rotating the drum to cause the cable to swing each successive row of fingers upwardly after all of the pipes thereon have been removed from them.

4. A pipe rack according to claim 1, in which each row of fingers is separated into a plurality of laterally spaced groups of fingers, and said fingers-swinging means include a separate drum mounted on said carriage for each group of fingers, separate cable means connected with each group of fingers and the drum for that group, and means on the carriage for rotating all of the drums in unison to wind said cable means thereon to thereby swing all of the fingers in each row upwardly together starting with the upper row and progressing downwardly.

5. A pipe rack according to claim 1, including transfer means for lifting from the upper fingers each successive pipe presented at said pick-up station and moving it lengthwise into a predetermined position.

6. A pipe rack according to claim 5, in which said transfer means include a pair of normally inclined parallel legs spaced lengthwise of pipe supported by said fingers, said legs being located beyond the free ends of said fingers, means pivotally supporting the lower ends of the legs on parallel axes, a transfer arm extending from the upper end of each leg laterally toward said pick-up station, the free end of each arm being formed to extend beneath the uppermost pipe at the pick-up station, and means for swinging said legs toward said predetermined position to cause said transfer arms to pick up a pipe and carry it there.

7. A pipe rack according to claim 1, in which said carriage-moving means include a traction screw extending parallel to said fingers, a nut mounted on the screw and secured to the carriage, and means for rotating said screw in either direction.

8. A pipe rack according to claim 1, in which said fingers-supporting means include a pair of elongated members inclined upwardly and away from the free ends of the fingers, and parallel shafts mounted in said inclined members, said fingers being pivotally mounted on said shafts.

9. A pipe rack according to claim 8, in which there are two fingers pivotally mounted on each shaft, and each pair of fingers is spaced farther from said inclined members than is the pair of fingers next below.

10. A pipe rack according to claim 9, including a sleeve rotatably mounted on each of said shafts and secured to a pair of said fingers, and said fingers-swinging means including a bracket projecting from each sleeve, an upper vertical sheave rotatably mounted in each bracket, lower vertical sheaves supported by said carriage below said upper sheaves, a drum rotatably mounted on said carriage, a cable having one end attached to the drum and extending therefrom around each lower and upper sheave alternately in succession starting with the sheave for the lowest pivoted fingers, means anchoring the opposite end of the cable, and means on the carriage for rotating the drum to cause the cable to swing each successive row of fingers upwardly after all of the pipes thereon have been removed from them.

* * * * *